US005092307A

United States Patent [19]

Behr et al.

[11] Patent Number: 5,092,307

[45] Date of Patent: Mar. 3, 1992

[54] ROOF MACHINE FOR PAINT FINISHING

[75] Inventors: Hans Behr, Stuttgart; Werner Hohnhaus, Schorndorf, both of Fed. Rep. of Germany

[73] Assignee: Behr Industrieanlagen GmbH & Co., Bietigheim-Bissingen, Fed. Rep. of Germany

[21] Appl. No.: 506,172

[22] Filed: Apr. 9, 1990

[51] Int. Cl.[5] ..... B05C 5/00

[52] U.S. Cl. ..... 118/315; 118/323

[58] Field of Search ..... 118/315, 323, 324, 631, 118/634

[56] References Cited

U.S. PATENT DOCUMENTS

| | | | |
|---|---|---|---|
| 2,083,634 | 6/1937 | Bracket | 118/323 |
| 2,321,983 | 6/1943 | Bracket | 118/323 |
| 2,840,037 | 6/1958 | Verba | 118/315 |

*Primary Examiner*—Richard V. Fisher

*Assistant Examiner*—Charles K. Friedman

*Attorney, Agent, or Firm*—Watson, Cole, Grindle & Watson

[57] ABSTRACT

A roof machine for the electrostatic paint coating of the front end, roof, and rear surfaces of an automobile chassis, transported on a conveyor belt includes a roof beam equipped with atomizers, the roof beam extending over the conveyor belt. Opposite ends of the roof beam are positioned in two vertical columns, one column containing the drive elements for the roof beam and the atomizers, and the other column containing the paint supply for the atomizers. The roof beam is positioned in the vertical columns that the roof beam can be moved up and down and can be rotated around its longitudinal axis as well, and the atomizers can be moved jointly back and forth and tilted and individually adjusted with respect to their lateral spacing relative to one another. The housing jacket of the roof beam is cylindrical.

8 Claims, 3 Drawing Sheets

ROOF MACHINE FOR PAINT FINISHING

BACKGROUND OF THE INVENTION

This invention relates to a roof machine for the electrostatic coating of the front end, roof and rear surfaces of an automobile chassis. Such roof machines are known and used in the painting lines of automobile plants.

The known roof machines generally comprise an elongated, box-like roof beam, which is located transversely over the conveyor belt within the spraying compartment and is suspended in the center of the roof in such a manner that it can be lowered and raised. A similar beam-like support for the atomizers hangs by means of arms on the bottom side of the roof beam, such that this holding beam can be reciprocated horizontally relative to the actual roof beam (pendulum motion) and can be rotated around its horizontal axis. All supply elements for the atomizers, namely the metering pumps, the control and changeover valves for the paint, and the pneumatic valves, and the drive motors and gears for the pendulum and rotating movements of the holding beam as well are housed in the roof beam, and in many cases also the drive motor for the up-and-down movement of the roof beam itself. The result is that the known roof beams are heavy and voluminous, a feature that not only requires very rigid roof constructions and strong drive motors for the beam movement but also induces, above all, significant flow turbulences in the spraying compartments. As well-known, such spraying compartment are continuously ventilated, the ventilation being achieved in that fresh air, which is supposed to flow from top to bottom as uniformly and linearly as possible through the spraying compartment, where the fresh air is delivered together with paint and solvent vapors, is supplied through openings distributed over the entire coiling of the spraying compartment. However, the roof beams, which are normally large in size for the aforementioned reasons, represent at this stage a signficant flow impedance, which, as smoke tests have demonstrated, generates significant turbulences, a feature that is extremely disadvantageous for the uniformity of the coating process. Additional disturbing factors for a uniform air flow constitute the hose bundles leading from the actual roof beam to the atomizer holding beam. Finally, it has been demonstrated that the many components carrying out the mechanical movements and located in the roof beam are a source of dust and lubricant vapors that may not be overlooked, given that during the painting of an automobile chassis it is important that the process be free of dust and lubricant vapors.

SUMMARY OF THE INVENTION

Therefore, the object of the present invention is to improve upon the known roof machines of the aforementioned type in such a manner that they disturb as little as possible a uniform air flow from the top to the bottom in the spraying compartment, are easy to build and to install and contribute to maintaining the spraying compartment free of dust and lubricant vapors.

Thus, according to the invention, the roof beam is held on both ends by vertical columns, the drives being in the one vertical column and the supply elements being in the other vertical column. Thus, the roof beam passing transversely through the spraying compartment contains only the atomizers, a drive shaft for the atomizers and their supply hoses, a feature which enables the roof beam to be designed as a cylinder having a comparatively small diameter. Such a roof beam can hardly impede the air flow, as has also been demonstrated with smoke tests, so that the result is no large air turbulences.

Other advantages and details of the invention follow from the following description of an embodiment.

DETAILED DESCRIPTION OF THE INVENTION

Figure 1:
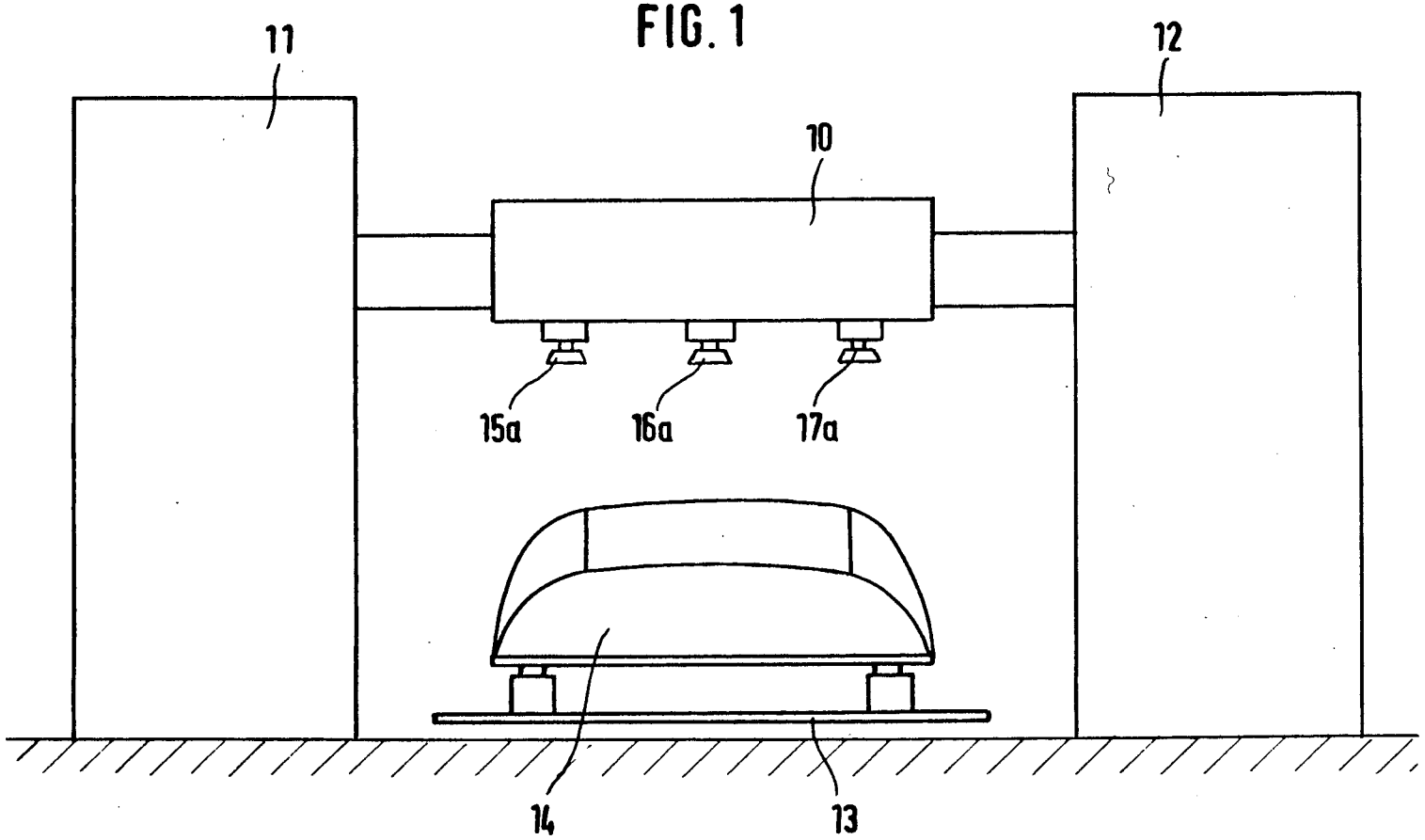
FIG. 1 is a schematic of the roof machine according to the invention.

The simplified schematic of FIG. 1 shows a roof machine with a horizontal roof beam 10, both ends of which are positioned at vertical columns 11 and 12. The roof beam 10 extends transversely over a conveyor belt 13, on which an automobile chassis 14 is located. The atomizer members that project out of the roof beam 10 and form part of three rotating atomizers positioned in roof beam 10 are denoted as 15*a*, 16*a*, and 17*a*.

Figure 2A:
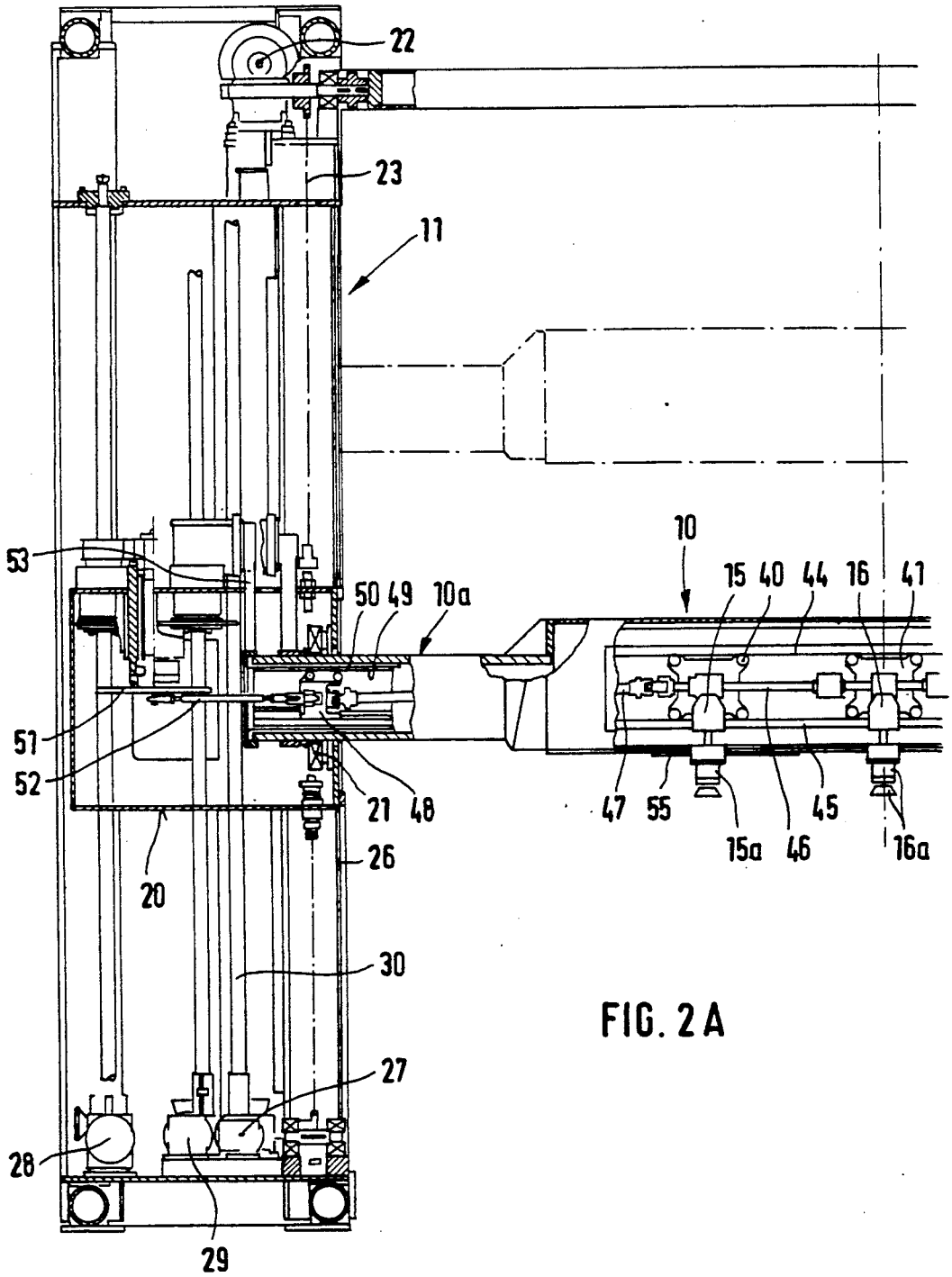
FIGS. 2A and 2B are vertical views partly in section of the left and right side of the roof machine.
Figure 2B:
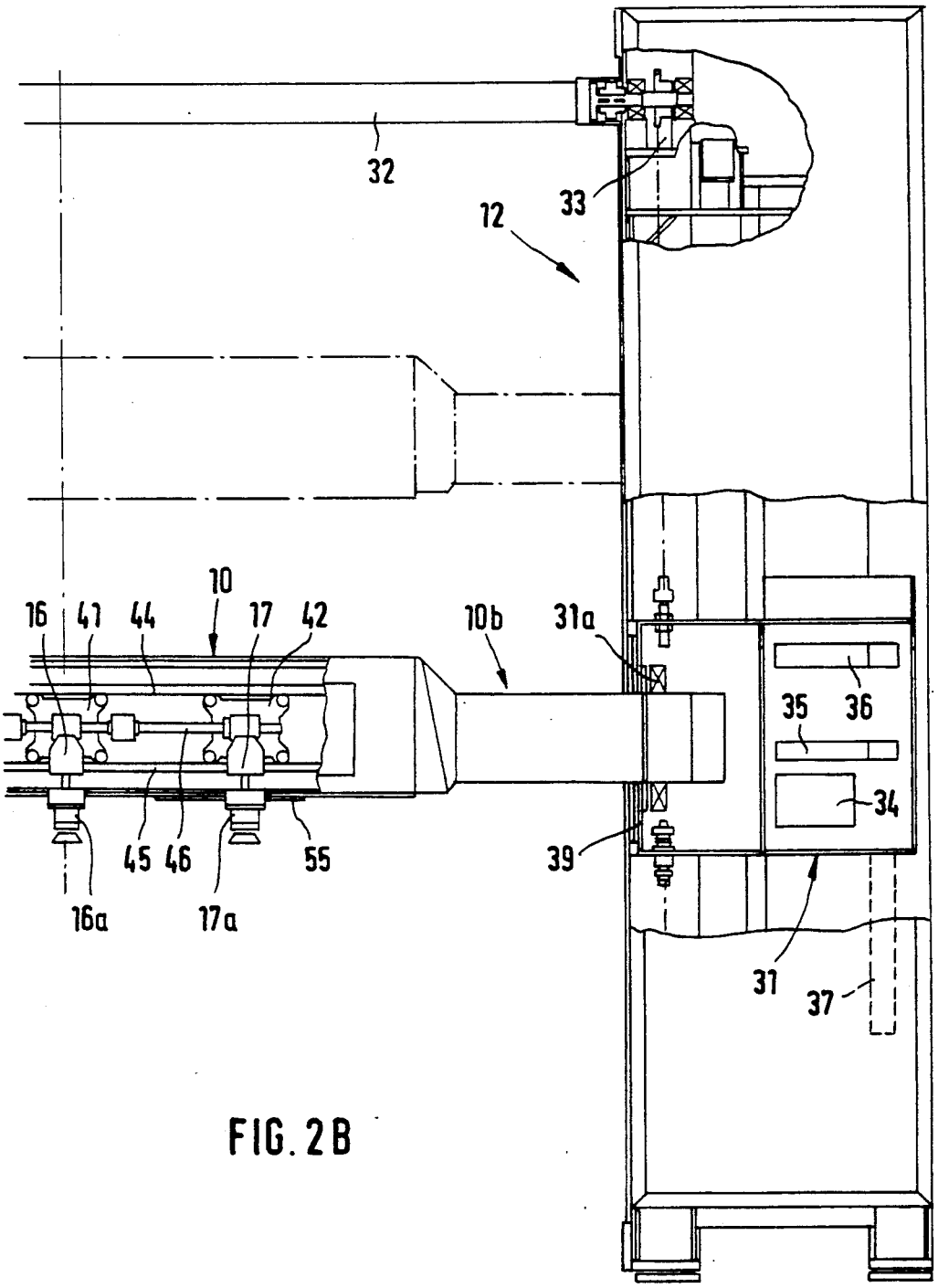

FIGS. 2A and 2B are detailed vertical views of the left and right side of the roof machine of FIG. 1. "The vertical column 11 having a rectangular cross-section and illustrated in FIG. 2A includes a bracket 20 to which a bearing 21 is mounted. The bearing 21 accommodates the tapered left and 10*a* of the roof beam having a circular cross-section in such a manner that the roof beam 10 can be rotated about a longitudinal axis. The bracket 20 can be moved up and down in column 11, wherein the drive to this vertical movement of the bracket 20 and thus of the roof beam 10 is via a motor 22 fixedly mounted at the upper region of the column 11. The transfer of force from the motor 22 to the bracket 20 consists of a chain 23. A counter-weight hangs on a steel rope and is connected to the bracket 20 via a guide pulley. The necessary opening for the up and down movement of the roof beam 10 is sealed with a peripheral plastic ribbon 26 in such a manner that the column jacket is closed in every height position of the roof beam 10. Other drive motors, in particular motors 27, 28 and 29 are housed in the base of the column 10. Motor 27 serves to rotate the roof beam 10 about its longitudinal axis, the force being transferred to bracket 20 by means of a torque shaft 30. Motors 28 and 29 serve to drive the atomizers 15, 16, 17 relative to the roof beam 10, as will be explained in detail below.

The right vertical column 12 shown in FIG. 2B corresponds in its outer dimensions to the afore described left column 11 and also has an up and down movable bracket denoted as 31. To accommodate the right tapered end 10*b* of the roof beam 10, the column is provided with a bearing 31. To synchronize the up and down movements of the two brackets 20 and 31, a horizontal synchronization shaft 32, which leads into the upper region of column 12, extends from drive motor 22, wherein the drive force is then transferred via a chain 33 to the bracket 31. The components, required to supply paint—thus, metering pumps 34, control valves 35 and painting mixing valves 36—are attached to the bracket 31. The pneumatic components required for the rotating drive of the atomizers are also located on this bracket 31. Furthermore, attached to bracket 31 is an energy guide chain 37, which accommodates all supply hoses (not illustrated) to the components located on bracket 31 and covers the entire vertical lift of the bracket 31 so as to avoid bending of the hoses. The balance of weight by a counter-weight and the sealing of the lift opening by a circumferential conveyor belt 39 has the same design as described for vertical column 11.

Atomizers 15, 16 and 17, are, as aforementioned, housed in the beam 10, wherein they are mounted on travelling carriages 40, 41 and 42, which travel on rails 44 and 45 mounted on the inner wall of the roof beam 10. The travelling carriages are penetrated by a horizontal shaft 46, both ends of which are designed as an opposing spindle and are connected friction-locked to the spindle. The two outer travelling carriages 40 and 42 are connected with the aid of a lock nut; the center travelling carriage 41 is connected by means of a shaft assembly. Thus, it is clear that when shaft 46 is rotated, the two outer atomizers 15 and 17 move in synchronization to the center atomizer 16 or away from it, whereas the center atomizer 16 remains stationary. In the case of a translatory movement of the shaft 46 to the right or to the left, the three atomizers 15, 16, 17 are also moved together.

To drive the shaft 46, the shaft is connected on its and facing vertical column 11 via an intermediate shaft 47 to a thrust-swivel joint 48, which can be moved on a linear guide 49, which is designed at the inner jacket of a bushing 50 that can be rotated in the roof beam 10. The displacement of joint 48 is affected by a crank 52 projecting from an eccentric 51; the eccentric 51 is driven by the aforementioned motor 28 via a shaft and a corner gear. The bushing 50 and thus the joint 48 are rotated by the motor 29, and in particular by a shaft, a corner gear and a toothed belt 53.

As mentioned above, the atomizers 15, 16, 17 project with their atomizer members 15*a*, 16*a*, 17*a* from the roof beam 10. The guides of at least both outer atomizers 15 and 17 through the roof beam jacket wall are designed as drawers 55, so that the beam wall at each displacement of the atomizers remains closed. Atomizers 15, 16 and 17 are connected via connecting hoses (not illustrated) to the paint supply elements located on bracket 31 of vertical column 12; even the connections (also not illustrated) for compressed air and high voltage are carried out from this side.

The roof machine operates as follows. If the arrival of an automobile chassis to be sprayed is reported, the outer atomizers 15 and 17 are moved, first of all, into the position corresponding to the chassis width by rotating the shaft 46 and the entire roof beam 10 is lowered to the height required to spray the front end of the chassis. Subsequently the atomizers 15, 16, 17 are put into a joint reciprocating movement (horizontal pendulum movement) by means of the shaft 46 and eccentric 51 and are caused to begin the spraying procedure. After the front end of the chassis has been sprayed, the roof beam 10 is lifted the height required to spray the roof of the chassis and subsequently lowered again to the height required to spray the horizontal rear end of the chassis. Finally the roof beam is lowered still further, simultaneously rotating the roof beam by about 90°, in order to spray, thus, from the rear the vertical rear end surface. Then the roof beam 10 returns into its driven up position with the atomizer members extending vertically downwards. The switching and control procedures for paint, compressed air and high voltage that are to be carried out in this process are known to the expert so that there is no need for further explanations.

A roof machine with extremely good flow is achieved with the invention, because the roof beam lying in the flow path of the ventilating air (flow from top to bottom) has only a comparatively small expansion (small diameter) and its cylindrical shape promotes good air flow, and in particular in each rotational position. At the same time the small diameter is due to the fact that neither drive motors and gears but rather only a drive shaft nor paint supply components but rather only connecting hoses are to be housed in the roof machine. Another great advantage lies in the fact that the drive shaft can be led to the atomizers from the one side and the connecting hoses can be led from the other side, thus damage to the hoses being avoided. Account is also largely taken of the requirement of no dust, because the dust generating part of the elements requiring lubrication are located in the closed columns. In this respect it is especially advantageous if the two columns 11 and 12 are located outside the vertical walls of the spraying compartment; thus, only the roof beam 10 and the synchronization shaft are located within the spraying compartment itself. In this case the columns 11 and 12 can also be designed as open racks.

Of course, the roof machine can experience many variations within the field of the invention. If, for example, the degree of freedom of the swivel (rotation of the roof beam) is not necessary for the atomizers, the roof beam can have a tear-shaped lining, thus promoting greater flow. If, however, an additional degree of freedom of movement is necessary for the atomizers, in particular a concomitant movement with the chassis, it is possible to design the two vertical columns traversible on rails parallel to the conveyor belt.

It is claimed:

1. A roof machine for the paint finishing of an automobile chassis located on a conveyor belt, comprising a horizontal hollow roof beam of circular cross-section transversely extending above the belt, a first hollow vertical column having a vertical movable support bracket, a second hollow vertical column having a vertically movable support bracket, said beam having opposing ends respectively mounted on said brackets for supporting said beam, said beam being rotatable about the central axis thereof and having downwardly facing openings, swiveling paint atomizers mounted within said beam for movement therealong, said atomizers extending through said openings, a drive motor for vertically moving said brackets being fixedly mounted only within said first column, drive motors for moving said atomizers and a drive motor for rotating said beam being fixedly mounted only within said first column, paint supply means for said atomizers being mounted only on said movable bracket of said second column, drive transmission means including drive gears for said motors being mounted only on said movable bracket of said first column, drive shaft means only extending into said beam from said first column, and connecting hoses and cables only extending into said beam from said second column.

2. The machine according to claim 1, wherein a drive chain extends between said bracket drive motor and said bracket of said first column.

3. The machine according to claim 1, wherein a horizontal synchronization shaft extends above said beam between said columns and is coupled at one end thereof to said bracket drive motor, a drive transmission chain extending between an opposite end of said shaft and said bracket of said second column, said shaft and said chain effecting synchronous movement of said brackets.

4. The machine according to claim 1, wherein said drive motors are located within a lower region of said first column.

5. The machine according to claim 1, wherein an eccentric disc is mounted only on said bracket of said first column and is driven by one of said drive motors for said atomizers, a crank of a thrust-swivel joint connected to said disc and mounted only on said bracket of said first column, and a drive shaft coupled to said joint and to said atomizers.

6. The machine according to claim 5, wherein longitudinal rails are located within one of said ends of said beam mounted on said bracket of said first column, said joint being supported on said rails for movement therealong together with said atomizers.

7. The machine according to claim 1, wherein longitudinal rails are located with said beam, carriages supporting said atomizers being supported on said rails for movement therealong.

8. The machine according to claim 1, wherein said hollow columns are closed on all sides and are provided with circumferential plastic ribbons to permit vertical movement of said roof beam.

* * * * *

UNITED STATES PATENT AND TRADEMARK OFFICE

CERTIFICATE OF CORRECTION

PATENT NO. : 5,092,307

DATED : March 3, 1992

INVENTOR(S) : Hans BEHR and Werner HOHNHAUS

It is certified that error appears in the above-identified patent and that said Letters Patent is hereby corrected as shown below:

On the Title page, insert the following:

--Foreign Application Priority Data
April 7, 1989 Germany ... P 39 11 454.6--

Signed and Sealed this

Twenty-first Day of September, 1993

Bruce Lehman

*Attest:*

BRUCE LEHMAN

*Attesting Officer*

*Commissioner of Patents and Trademarks*